US006837013B2

(12) United States Patent
Foderberg et al.

(10) Patent No.: US 6,837,013 B2
(45) Date of Patent: Jan. 4, 2005

(54) LIGHTWEIGHT PRECAST CONCRETE WALL PANEL SYSTEM

(76) Inventors: Joel Foderberg, 13904 Lucille St., Overland Park, KS (US) 66221; Gary Foderberg, 11000 W. 177th Terrace, Olathe, KS (US) 66062

( * ) Notice: Subject to any disclaimer, the term of this patent is extended or adjusted under 35 U.S.C. 154(b) by 54 days.

(21) Appl. No.: 10/267,985

(22) Filed: Oct. 8, 2002

(65) Prior Publication Data

US 2004/0065043 A1 Apr. 8, 2004

(51) Int. Cl.[7] ..... E04B 1/14

(52) U.S. Cl. ..... 52/356; 52/600; 52/602; 52/320; 52/326; 52/327; 52/354; 52/378; 52/379; 52/730.2; 52/735

(58) Field of Search ..... 52/354, 378, 379, 52/320, 326, 327, 600, 602, 730.2, 735

(56) References Cited

U.S. PATENT DOCUMENTS

| | | | | | |
|---|---|---|---|---|---|
| 1,994,716 | A | * | 3/1935 | Klemperer | 52/634 |
| 2,945,328 | A | | 7/1960 | Webb | |
| 3,557,511 | A | | 1/1971 | Curran | |
| 3,956,864 | A | | 5/1976 | Fung | |
| 4,373,314 | A | * | 2/1983 | Allan | 52/434 |
| 4,437,272 | A | * | 3/1984 | Johnson | 52/64 |
| 4,472,919 | A | * | 9/1984 | Nourse | 52/601 |
| 4,602,467 | A | | 7/1986 | Schilger | |
| 4,703,602 | A | * | 11/1987 | Pardo | 52/564 |
| 4,751,803 | A | | 6/1988 | Zimmerman | |
| 4,909,007 | A | * | 3/1990 | Bodnar | 52/356 |
| 4,972,537 | A | | 11/1990 | Slaw, Sr. | |
| 5,072,565 | A | * | 12/1991 | Wilnau | 52/600 |
| 5,239,798 | A | * | 8/1993 | Saito | 52/235 |
| 5,414,972 | A | * | 5/1995 | Ruiz et al. | 52/600 |
| 5,758,463 | A | | 6/1998 | Mancini, Jr. | |
| 5,809,703 | A | | 9/1998 | Kelly | |
| 5,884,442 | A | * | 3/1999 | Breault | 52/245 |
| 5,975,810 | A | * | 11/1999 | Taylor et al. | 405/262 |
| 6,000,194 | A | | 12/1999 | Nakamura | |
| 6,003,278 | A | | 12/1999 | Weaver et al. | |
| 6,230,465 | B1 | * | 5/2001 | Messenger et al. | 52/630 |
| 6,668,507 | B2 | * | 12/2003 | Blanchet | 52/601 |
| 6,701,683 | B2 | * | 3/2004 | Messenger et al. | 52/309.11 |
| 6,708,459 | B2 | * | 3/2004 | Bodnar | 52/356 |

OTHER PUBLICATIONS

U.S. Office Action dated Apr. 14, 2004, in U.S. Appl. No. 10/404,588; Claim Rejections, pp. 4–7 (with copy of claims pending therein).

* cited by examiner

*Primary Examiner*—Carl D. Friedman
*Assistant Examiner*—Christy Green
(74) *Attorney, Agent, or Firm*—Hovey Williams LLP

(57) ABSTRACT

Wall system employing lightweight precast concrete wall panels. The precast wall panels include a concrete slab and a plurality of spaced-apart elongated generally parallel bent sheet metal channels that are partially embedded in the slab. Each wall panel can be coupled to a support wall by extending self-tapping screws through metallic wall framing members and the channels at locations where the framing members and channels cross.

16 Claims, 8 Drawing Sheets

LIGHTWEIGHT PRECAST CONCRETE WALL PANEL SYSTEM

BACKGROUND OF THE INVENTION

1. Field of the Invention

The present invention relates generally to exterior wall systems for commercial and residential structures. In another aspect, the invention concerns lightweight prefabricated wall panels. In a further aspect, the invention relates to precast concrete wall panels.

2. Description of the Prior Art

Precast concrete wall panels have been used for years to provide durable and aesthetically pleasing exterior walls. One disadvantage of traditional precast concrete wall panels is the weight of the panels. The high weight of conventional precast wall panels can make them expensive to ship and erect. Further, because heavy wall panels cause deflection of structural steel wall members supporting the panels, the strength of the steel frame of a building may need to be increased in order to adequately support concrete wall panels without excessive deflection. Such a need to increase the strength of the structural steel members of a building can add significantly to the overall cost of the building.

In recent years, several lightweight alternatives to traditional precast concrete wall panels have been used. One such system is commonly known as EIFS (Exterior Insulation and Finish System). EIFS is a multi-layered exterior wall system that typically consists of a lightweight pliable insulation board covered with a fiberglass reinforced base coat that is coated with a colored acrylic finish coat. Although EIFS is lightweight and provides thermal insulation, a number of drawbacks are associated with EIFS. For example, EIFS walls have a tendency to crack and allow moisture to seep between the EIFS layers or between the innermost EIFS layer and the interior wall. In either case, such leakage can cause water damage and/or damage due to mold or mildew. In fact, the tendency of EIFS wall systems to leak has caused many insurance companies to stop writing policies covering EIFS structures. A further disadvantage of EIFS is its lack of durability. For example, simply bumping an EIFS wall with a lawn mower or other equipment during routine lawn maintenance can physically and visibly damage the EIFS wall, thereby necessitating expensive repair. Another problem with EIFS is the inability to form a true caulk joint at the edge of the wall. This inability to form a true caulk joint is caused by the fact that EIFS walls lack a sufficiently thick rigid edge. A proper caulk joint typically requires at least one inch of rigid edge so that a backer-rod can be inserted into a joint and a bead of caulk can fill the joint and seal against at least one half inch of the rigid edge. This allows the seal to maintain integrity during normal shifting and expansion/contraction of the structure. Thus, the lack of a true caulk joint in EIFS walls can contribute to moisture leakage.

Another lightweight wall system that has been introduced in recent years employs precast GFRC (Glass Fiber Reinforced Concrete) wall panels. GFRC wall panels are relatively strong compared to EIFS, but have a number of drawbacks. The main drawback of GFRC wall panels is expense. The making of GFRC wall panels is a labor intensive process wherein concrete and glass fibers are sprayed in a form. In addition to high labor costs associated with GFRC fabrication, the material cost of the glass fibers adds significantly to the overall cost of a GFRC wall panel.

Another relatively lightweight wall panel system that is being used today is commonly known as "slender wall."

Slender wall prefabricated wall panels typically include a relatively thin steel-reinforced concrete slab with structural steel framing rigidly attached to one side of the slab. A disadvantage of the slender wall system is that it requires the concrete supplier to fabricate the metal frame backup system, which requires a significant amount of design and fabrication time. Another disadvantage is that the inside face of the metal frame must be in near perfect alignment for proper drywall attachment.

OBJECTS AND SUMMARY OF THE INVENTION

Responsive to these and other problems, it is an object of the present invention to provide a lightweight, durable, and inexpensive prefabricated wall panel system.

A further object of the invention is to provide a lightweight prefabricated wall panel of sufficient rigidity and thickness so that a proper caulk joint can be formed around the edge of the panel.

Another object of the invention is to provide a prefabricated wall panel system that can easily be attached to a thin metal framing member (e.g., a metal stud or C/Z purlin) of a support wall system.

Still another object of the invention is to provide an improved method of constructing a wall using lightweight precast wall panels.

Yet another object of the invention is to provide an improved method of making a lightweight prefabricated wall panel.

It should be understood that not all of the above-listed objects need be accomplished by the present invention, and further objects and advantages of the invention will be apparent from the following detailed description of the preferred embodiment, the drawings, and the claims.

Accordingly, in one embodiment of the present invention there is provided a lightweight precast wall panel comprising a concrete slab and a plurality of elongated spaced-apart channels coupled to the slab. Each of the channels includes a substantially flat cross member and a pair of spaced-apart side members extending from the cross member. The side members are partially embedded in the slab and the cross member is spaced from the slab.

In another embodiment of the present invention, there is provided a method of constructing a wall comprising the steps of: (a) erecting a support wall having a plurality of generally parallel spaced-apart elongated metallic outer wall framing members; (b) positioning a precast concrete wall panel adjacent the support wall, with the wall panel including a concrete slab and a plurality of generally parallel spaced-apart elongated metallic channels that are partially embedded in the slab; and (c) coupling the wall panel to the support wall by extending self-tapping screws through the channels and the wall framing members at attachment locations where the channels and the framing members cross.

In still another embodiment of the present invention, there is provided a precast concrete wall system comprising a support wall, a precast wall panel, and a plurality of fasteners. The support wall includes a plurality of generally parallel spaced-apart elongated metallic framing members. The wall panel includes a concrete slab and a plurality of generally parallel spaced-apart elongated metallic channels. The channels are partially embedded in the slab and are elongated in a direction that is substantially perpendicular to the direction of elongation of the framing members. The fasteners extend through the framing members and the channels at attachment locations where the framing members and channels cross.

In yet another embodiment of the present invention, there is provided a method of making a precast wall panel comprising the steps of: (a) stamping a first series of openings in a substantially flat piece of sheet metal; (b) stamping a second series of openings in the sheet metal; (c) cutting the sheet metal along the first and second series of openings to form an elongated sheet metal section having opposite first and second edges at least partly defined by the first and second series of openings, respectively; and (d) bending the elongated sheet metal section along two substantially parallel bend lines, thereby forming a channel member having a generally flat cross member defined between the two bend lines, a first side member extending from the cross member at one of the bend lines, and a second side member extending from the cross member at the other bend line.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
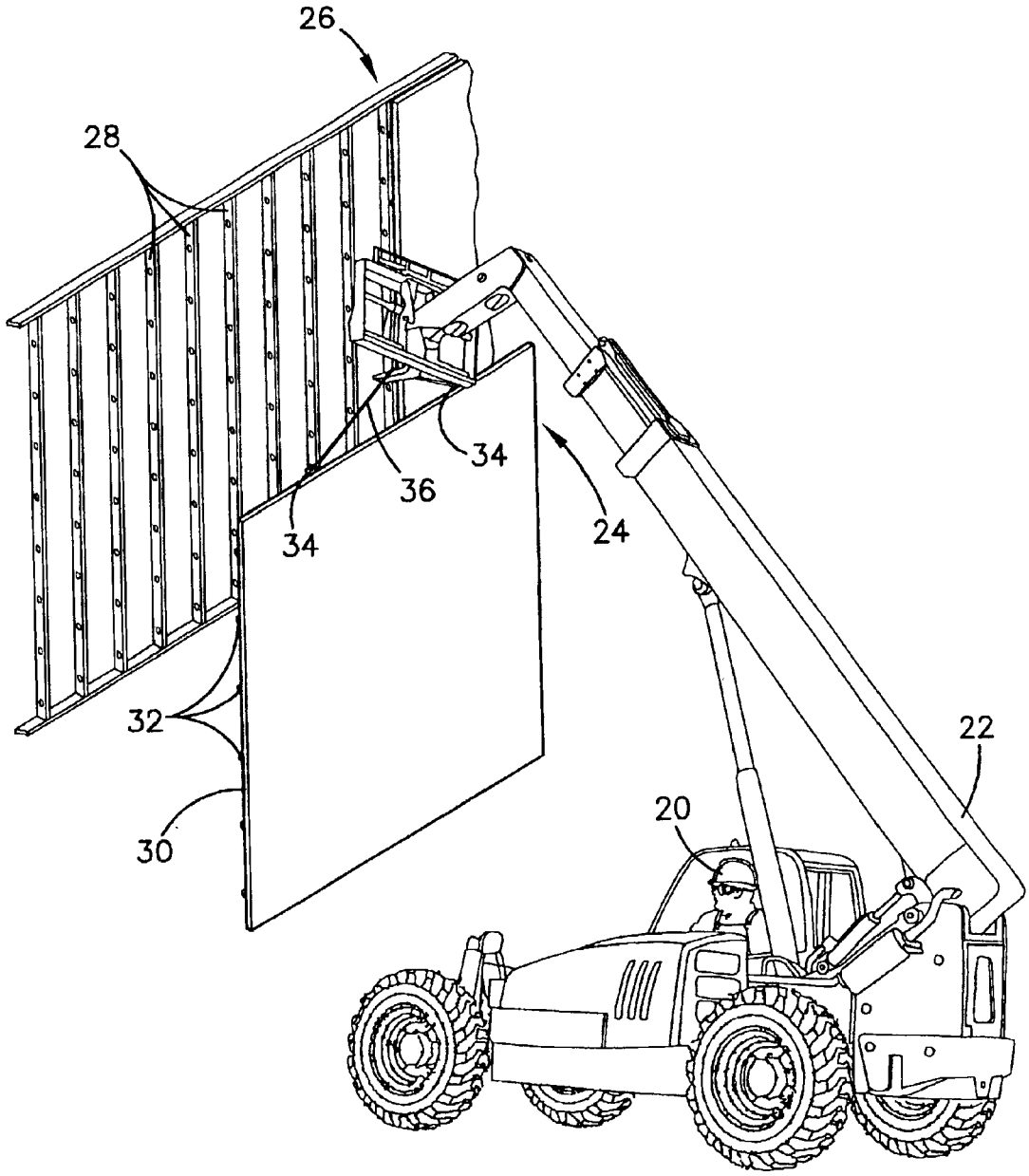
FIG. 1 is a perspective view of a wall system being constructed in accordance with the principles of the present invention, particularly illustrating the manner in which a prefabricated wall panel is erected on a support wall having a plurality of thin metal framing members.

Referring initially to FIG. 1, an operator 20 of lift 22 is shown performing the operation of placing a prefabricated wall panel 24 on a structural or nonstructural support wall 26. Support wall 26 is preferably an exterior building wall that includes a plurality of spaced-apart generally parallel elongated thin metal framing members 28 for supporting wall panel 24. Metal framing members 28 can be any thin metal member such as, for example, C-shaped metal studs, C-shaped purlins, or Z-shaped purlins. The orientation of metal framing members 28 can be either vertical (typical for metal studs) or horizontal (typical for C/Z purlins). Wall panel 24 generally includes a lightweight precast concrete slab 30 and a plurality of channels 32. Channels 32 are partially embedded in concrete slab 30 and are used to attach wall panel 24 to support wall 26, as described in detail below. Slab 30 is preferably formed of concrete that is predominately reinforced by steel reinforcement members (i.e., not fiberglass reinforced concrete). Wall panel 24 further includes a pair of handles 34 to which a cable 36 can be attached in order to allow lift 22 to manipulate wall panel 24 proximate support wall 26.

Figure 2:
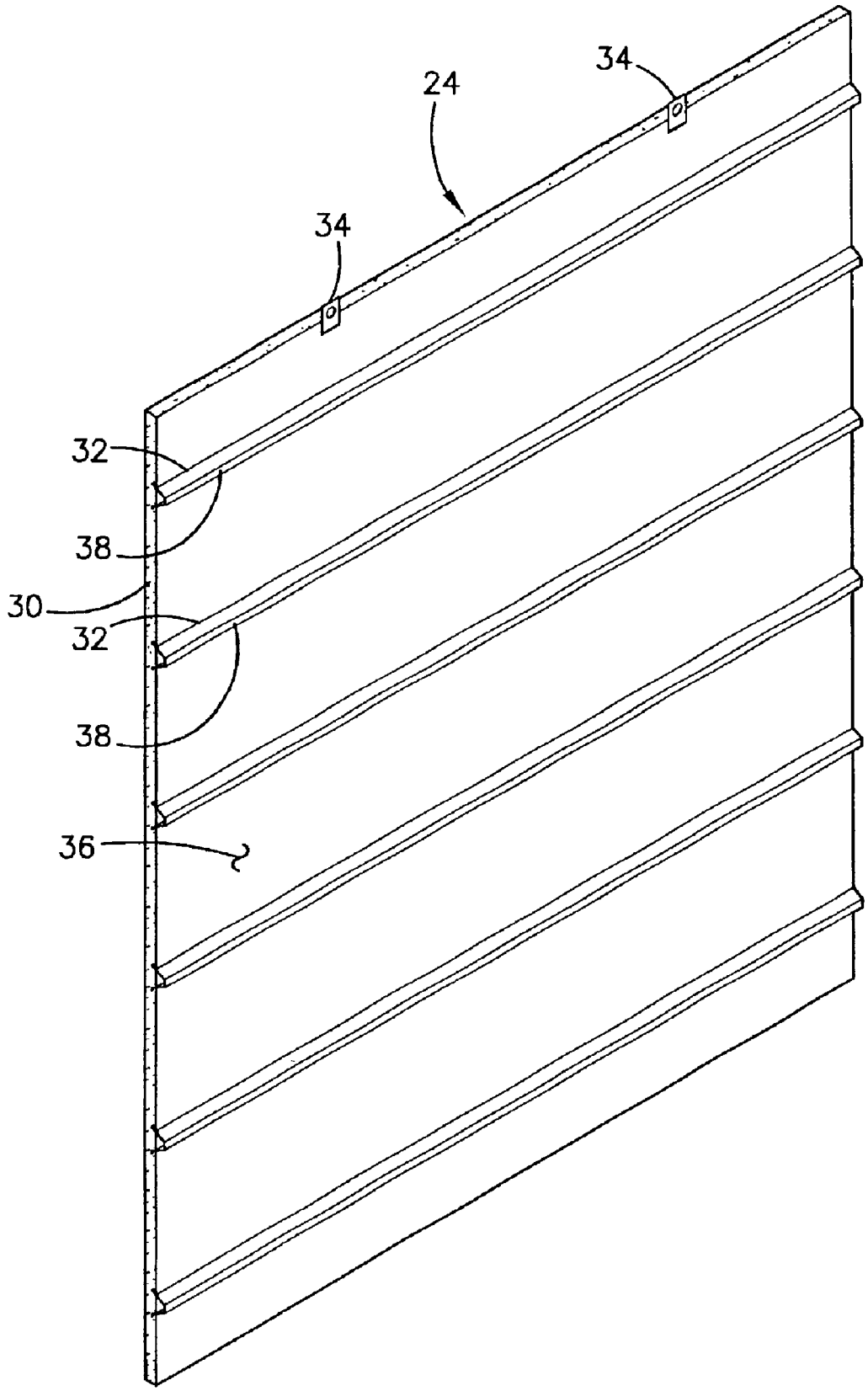
FIG. 2 is a perspective view of a prefabricated wall panel constructed in accordance with the principles of the present invention, particularly illustrating a plurality of spaced-apart elongated metallic channels partially embedded in a concrete slab and protruding from an inside surface of the slab.

Referring to FIG. 2, elongated channels 32 of wall panel 24 are illustrated as extending generally parallel to one another, substantially the full width of slab 30. Channels 32 are rigidly coupled to slab 30 by partial embedding of channels 32 in slab 30. Channels 32 project outwardly from a substantially flat inside surface 36 of slab 30. Each of channels 32 presents a generally flat outer channel surface 38 that is spaced from and extends substantially parallel to inside surface 36 of slab 30. Outer channel surfaces 38 of all channels 32 are preferably substantially coplanar.

The shape, size, and weight of wall panel 24 can vary greatly depending on the particular application for which wall panel 24 is used. However, it is an object of the present invention to provide a concrete wall panel that is significantly lighter than traditional concrete wall panels. Thus, it is preferred for wall panel 24 to have a weight in the range of from about 5 to about 30 pounds per square foot, more preferably in the range of from about 10 to about 20 pounds per square foot, and most preferably in the range of from 12 to 18 pounds per square foot. It is further preferred for the thickness of slab 30 to be in the range of from about 1 to about 4 inches, more preferably in the range of from about 1.25 to about 3 inches, and most preferably in the range of from 1.5 to 2 inches. Although the length and width of slab 30 can vary greatly depending on the specific application for which slab 30 is fabricated, it is preferred for slab 30 to have a length in the range of from about 4 to about 20 feet and a width in the range of from about 4 to about 15 feet, more preferably a length in the range of from 8 to 16 feet and a width in the range of from 6 to 12 feet. The spacing between generally parallel channels 32 is preferably in the range of from about 0.5 to about 5 feet, more preferably in the range of from about 1 to about 3 feet, and most preferably in the range of from 1.5 to 2.5 feet. Channels 32 preferably have a continuous length that is at least 75 percent of the width of slab 30, more preferably at least 90 percent of the width of slab 30. Most preferably, channels 32 have a continuous length that is approximately 100 percent of the width of slab 30, thereby providing channels 32 that continuously extend entirely across slab 30. Because channels 32 provide the means for which wall panel 24 is coupled to support wall 26 (shown in FIG. 1), it is important that channels 32 are embedded in slab 30 in a manner which prevents "pull out"

of channels 32 from slab 30. Thus, each channel preferably has a pull out strength of at least 250 pounds per linear foot. Preferably, each channel 32 has a pull out strength in the range of from about 500 to about 1,000 pounds per foot, and most preferably in the range of from 1,000 to 3,000 pounds per foot. Each channel 32 is preferably formed of a single piece of bent sheet metal. Preferably, the sheet metal used to form channels 32 is a 14 to 26 gauge sheet metal, most preferably an 18 to 22 gauge sheet metal.

Figure 3:
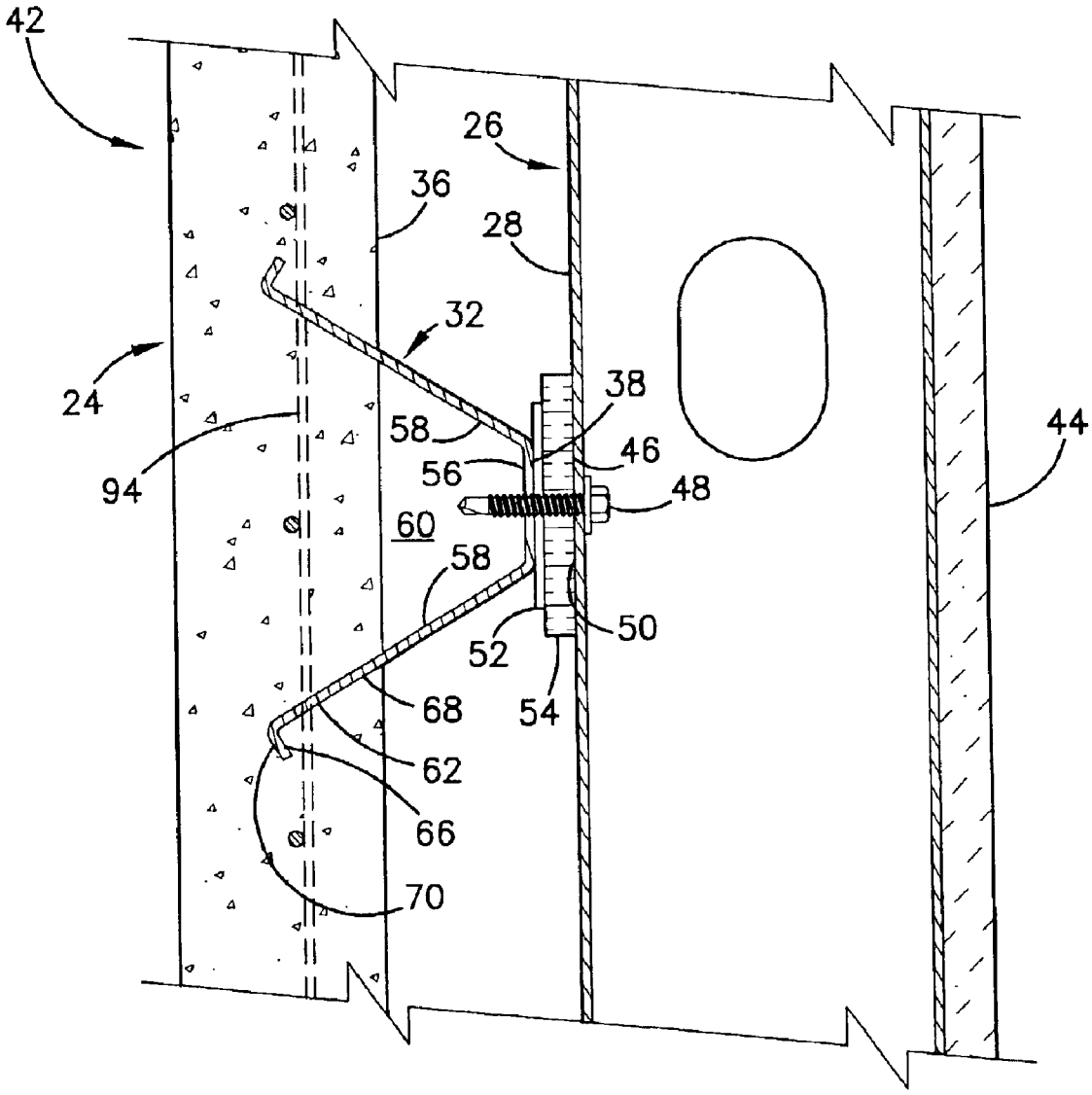
FIG. 3 is a partial sectional view of a wall system constructed in accordance with the principles of the present invention, particularly illustrating the manner in which the prefabricated wall panel is coupled to the support wall by extending a self-tapping screw through a thin metal framing member of the support wall and a metallic channel of the prefabricated wall panel.

Referring to FIG. 3, a wall system 42 is illustrated as generally comprising wall panel 24, support wall 26, and an interior wall 44. Channel 32 of wall panel 24 is coupled to thin metal framing member 28 (illustrated as a C-shaped metal stud) of support wall 26 at an attachment location 46 where channel 32 crosses metal framing member 28. Referring to FIGS. 1–3, when wall panel 24 is placed adjacent support wall 26, it is preferred for the direction of elongation of spaced-apart channels 32 to be substantially perpendicular to the direction of elongation of spaced-apart metal framing members 28 so that a plurality of attachment locations 46 are available at points where channels 32 cross metal framing members 28. Referring again to FIG. 3, it is preferred for wall panel 24 to be attached to thin metal framing members 28 at each attachment location 46 via a self-tapping screw 48 that extends through metal framing member 28 and channel 32. As used herein, the term "self-tapping screw" shall denote a screw having a threaded shaft and an unthreaded tip that is configured similar to the tip of a standard drill bit. The tip of the self-tapping screw is operable to create a hole in sheet metal or another relatively thin material. The hole created by the tip has a sufficient diameter to allow the threaded shaft to be threaded therethrough, thereby firmly attaching the self-tapping screw to the sheet metal or other thin member. A variety of self-tapping screws suitable for use in the present invention are commercially available from various suppliers.

The use of self-tapping screws 48 as the primary means for attaching wall panel 24 to support wall 26 and supporting wall panel 24 on support wall 26 provides numerous advantages. For example, the alignment of wall panel 24 relative to support wall 26 can be readily adjusted because a proper attachment location 46 can be formed at any location where channel 32 crosses thin metal framing member 28. Further, it is not necessary for the outer channel surface 38 of each channel 32 to fit flushly with the outer framing member surface 50 of each metal framing member 28 because a shim 52 can readily be placed between outer channel surface 38 of channel 32 and outer framing member surface 50 of metal framing member 28 to fill any gap between thin metal framing member 28 and channel 32 prior to extending self-tapping screw 48 through metal framing member 28, shim 52, and channel 32. Further, this configuration for attaching wall panel 24 to support wall 26 allows thermal insulation 54 to be placed between outer channel surface 38 and outer framing member surface 50 at each attachment location 46. Such thermal insulation 54 can enhance the thermal efficiency of wall system 42 by inhibiting thermal conduction between channel 32 and metal framing member 28.

Because self-tapping screw 48 is the preferred means for coupling channel 32 to metal framing member 28, metal framing member 28 and channel 32 must be configured to allow self-tapping screw 48 to extend therethrough. Thus, it is preferred for both metal framing member 28 and channel 32 to be formed of thin metal. Preferably, the thickness of metal framing member 28 and channel 32 at attachment location 46 is in the range of from about 0.01 to about 0.2 inches, more preferably in the range of from about 0.02 to about 0.1 inches, and most preferably in the range of from 0.03 to 0.05 inches. This thickness of metal framing member 28 and channel 32 is thin enough to allow self-tapping screw 48 to readily create a hole in metal framing member 28 and metallic channel 32, but is thick enough to allow formation of a suitably strong connection between metal framing member 28 and metallic channel 32 via self-tapping screw 48.

Figure 4:
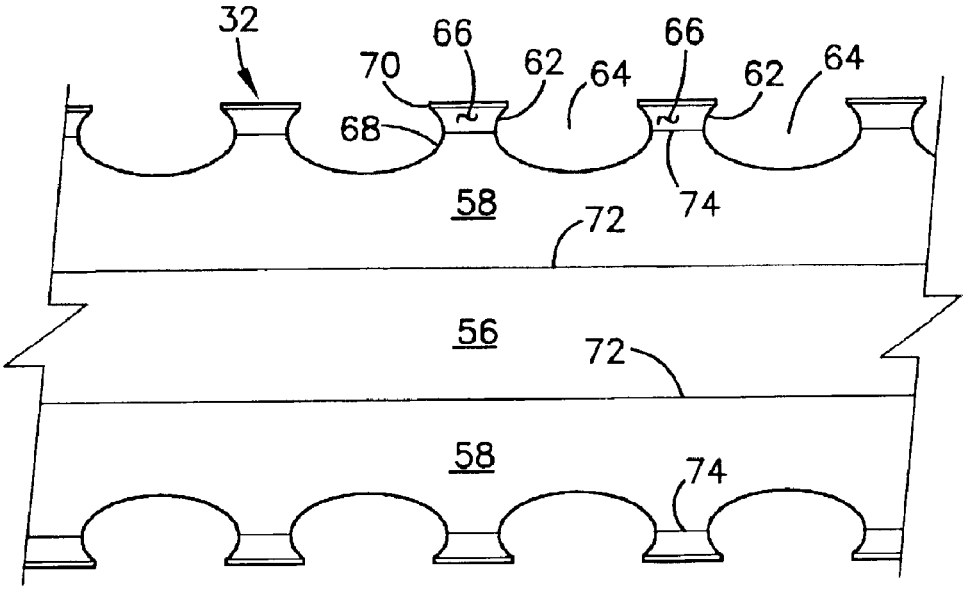
FIG. 4 is a partial top view of a metallic channel suitable for use in the inventive prefabricated wall panel.
Figure 5:
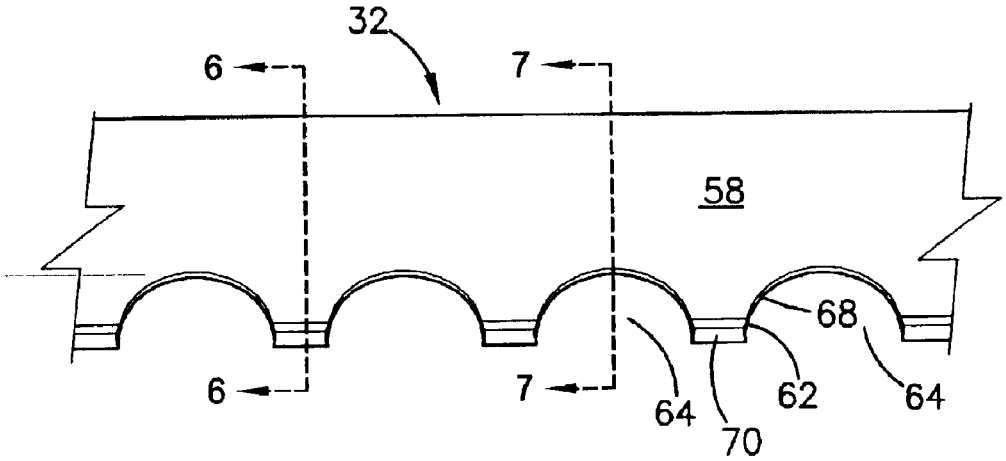
FIG. 5 is a partial side view of the metallic channel shown in FIG. 4.
Figure 6:
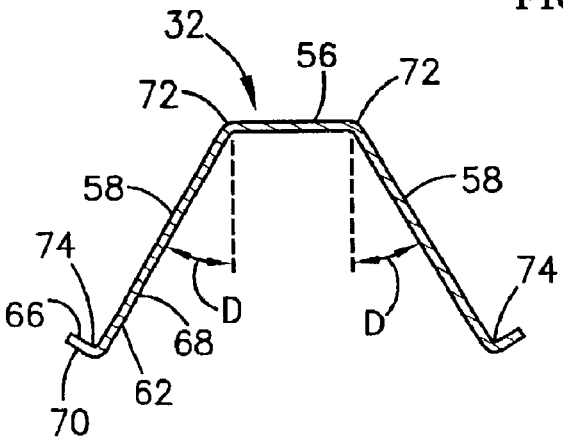
FIG. 6 is a sectional view of the metallic channel taken along line 6—6 in FIG. 5, particularly illustrating the generally hat-shaped configuration of the metallic channel.
Figure 7:
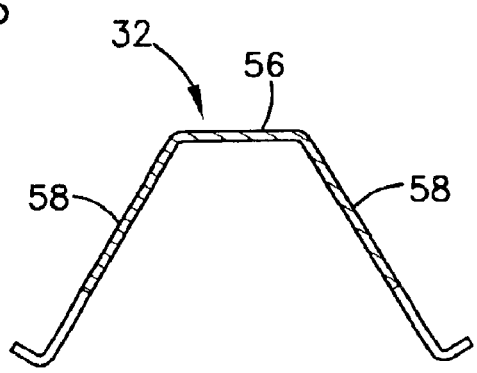
FIG. 7 is a sectional view of the metallic channel taken along line 7—7 in FIG. 5.

Referring now to FIGS. 3–7, the configuration of channel 32 is an important aspect of one embodiment of the present invention. Each channel 32 preferably includes a substantially flat cross member 56 and a pair of side members 58 extending from generally opposite edges of cross member 56. Referring again to FIG. 3, self-tapping screw 48 is extended through metal framing member 28 and cross member 56 in order to attach wall panel 24 to support wall 26. In order to provide sufficient space for self-tapping screw 48 to extend through cross member 56, a gap 60 must exist between cross member 56 and inside surface 36 of slab 30. Gap 60 allows self-tapping screw 48 to be extended through thin metal framing member 28 and cross member 56 without contacting slab 30. It is preferred for gap 60 (defined between cross member 56 and inside surface 36 of slab 30) to be in the range of from about 0.25 to about 4 inches, more preferably in the range of from about 0.5 to about 3 inches, and most preferably in the range of from 1 to 2 inches. Referring to FIG. 6, it is preferred for cross member 56 to have a width in the range of from about 0.5 to about 4 inches, more preferably in the range of from 0.75 to 2 inches. It is further preferred for each side member 58 to have a length in the range of from about 1 to about 5 inches, more preferably in the range of from 1.5 to 3.5 inches. Referring again to FIG. 6, it is preferred for side members 58 of each channel 32 to diverge from one another as they extend from cross member 56. A divergence angle D is defined between each side member 58 and an imaginary plane extending perpendicular to cross member 56 along the junction of side member 58 and cross member 56. Preferably, divergence angle D is in the range of from about 10 to about 60 degrees, more preferably in the range of from about 15 to about 45 degrees, and most preferably in the range of from 25 to 35 degrees.

Referring again to FIG. 3, each side member 58 is partially embedded in slab 30. Thus, each side member 58 includes an embedded portion (embedded in slab 30) and an exposed portion (not embedded in slab 30). Preferably, 20 to 80 percent of each side member 58 is embedded in slab 30. Most preferably, 30 to 50 percent of each side member 58 is embedded in slab 30. Preferably, the embedded portion of each side member 58 extends below inside surface 36 of slab 30 a distance in the range of from about 0.25 inches to about 2 inches, most preferably in the range of from 0.5 to about 1 inch. Preferably, the exposed portion of each side member 58 extends outwardly from inside surface 36 of slab 30 a distance in the range of from about 0.5 to about 4 inches, more preferably in the range of from about 0.75 to about 3 inches, and most preferably in the range of from 1.0 to 2.0 inches.

Referring to FIGS. 3–7, each side member 58 includes a plurality of projections 62 defined between a plurality of notches 64. Referring to FIGS. 4 and 5, projections 62 of each side member 58 are preferably spaced on 1 to 4 inch centers, more preferably on 1.5 to 2.5 inch centers. Preferably, each notch 64 extends into the side member 58 a distance in the range of from about 0.25 to 2 inches, most preferably in the range of from 0.5 to 1 inch.

Referring to FIG. 3, each projection 62 is embedded in slab 30 and defines a holding surface 66 adapted to prevent pull out of channel 32 from slab 30. Preferably, holding surface 66 faces generally towards inside surface 36 of slab 30 and is defined along a plane that is generally transverse to the plane along which the exposed portion of corresponding side member 58 is defined. It is preferred for each holding surface 66 of each projection 62 to present an area in the range of from about 0.05 to about 1 inch, most preferably in the range of from 0.2 to 0.5 inches. Referring to FIGS. 3–7, each projection 62 preferably includes a leg 68 and a foot 70. Leg 68 is embedded in slab 30 and is substantially coplanar with the exposed portion of side member 58. Foot 70 is embedded in slab 30 and presents holding surface 66. Foot 70 is defined along a plane that extends generally transverse to the plane along which the exposed portion of side member 58 is defined. Referring to FIGS. 4 and 6, it is preferred for each channel 32 to be formed of a single piece of bent sheet metal. Thus, two substantially parallel top bend lines 72 define the junction between cross member 56 and side members 58, and two series of substantially parallel bottom bend lines 74 define the junction between leg 68 and foot 70 of each projection 62.

Figure 8:
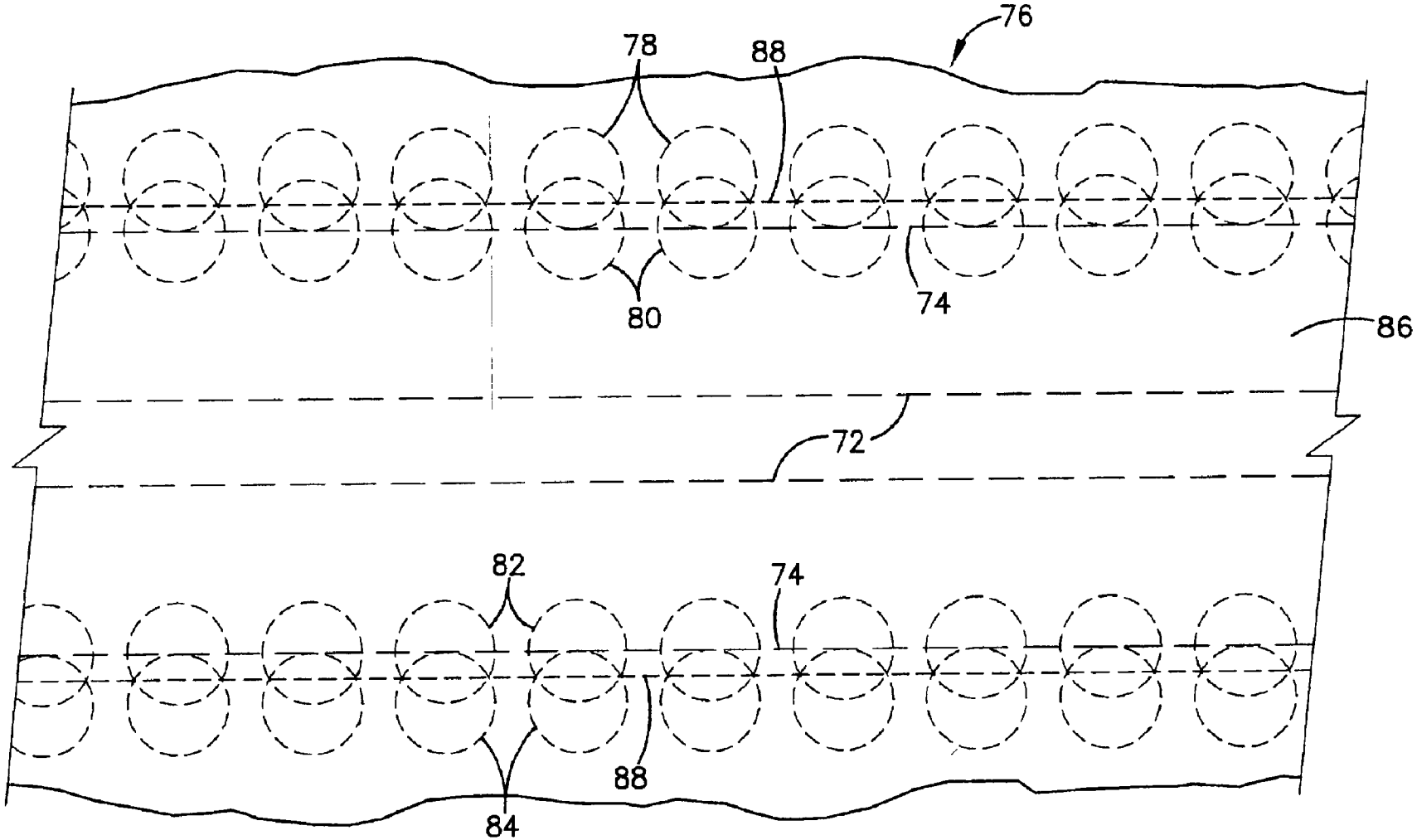
FIG. 8 is a partial top view of a piece of sheet metal, particularly illustrating the pattern of openings to be stamped in the sheet metal, the cut lines along which the sheet metal will be cut, and the bend lines along which the sheet metal will be bent to form the metallic channels.

The configuration of each channel 32, described herein, allows each channel 32 to be quickly and inexpensively made out of standard sheet metal. Referring now to FIG. 8, a single piece of substantially flat sheet metal 76 is illustrated with dashed lines to show the locations at which sheet metal 76 will be cut and bent to form channels 32. In order to form channel 32, a first, second, third, and fourth series of openings 78, 80, 82, 84 are stamped in sheet metal 76 using conventional metal stamping techniques. Next, metal sheet 76 is formed into individual elongated pieces 86 by cutting along cut lines 88. Each individual elongated piece 86 is then bent along top and bottom bend lines 72, 74, to thereby form channels 32 having the generally hat-shaped orthogonal cross section shown in FIG. 6. As used herein, the term "orthogonal cross section" shall denote a view cut along a plane generally orthogonal to the direction of elongation of a member. As used herein, the term "hat-shaped" shall denote a shape including a top cross member, two spaced-apart side members extending generally downward from opposite edges of the top cross member, and two foot members extending generally outward from respective ends of the side members.

Figure 9:
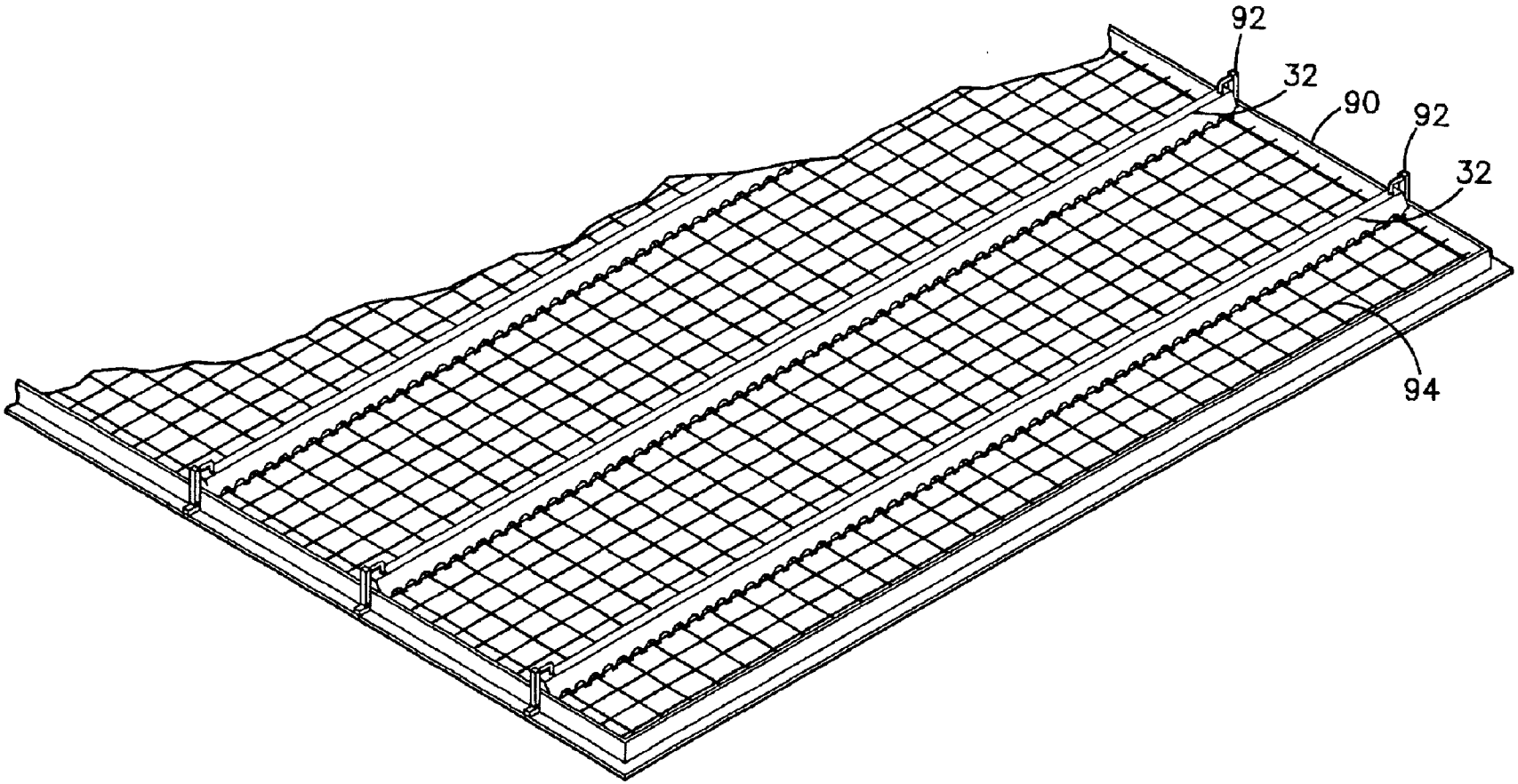
FIG. 9 is a perspective view of a concrete wall panel form system, particularly illustrating the manner in which the elongated channels and the reinforcing members are configured in the form prior to placing concrete in the form.
Figure 10:
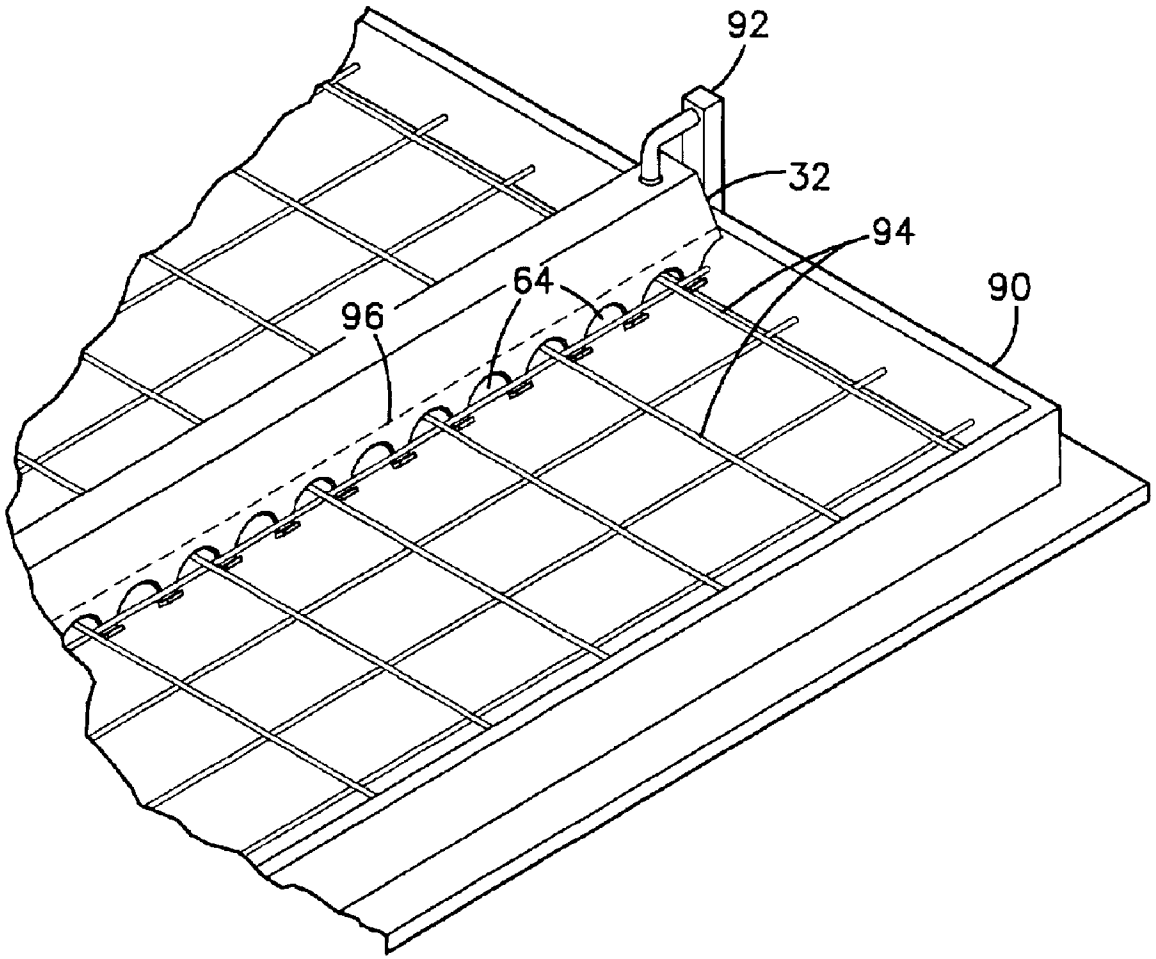
FIG. 10 is an enlarged perspective view of the concrete wall panel form system shown in FIG. 9, particularly illustrating the manner in which the reinforcing members extend through notches in the metallic channels.

Referring to FIGS. 9 and 10, once channels 32 have been manufactured, as described above, channels 32 can be fixed in a concrete form 90 via clamps 92. It is preferred for steel reinforcing members 94 (e.g., steel mesh or rebar) to be placed in form 90 prior to placement of channels 32 in form 90. Referring to FIG. 10, notches 64 in channel 32 provide openings through which steel reinforcing members 94 can extend. FIG. 10 also illustrates a dashed fill line 96 up to which concrete can be placed in form 90.

Figure 11:
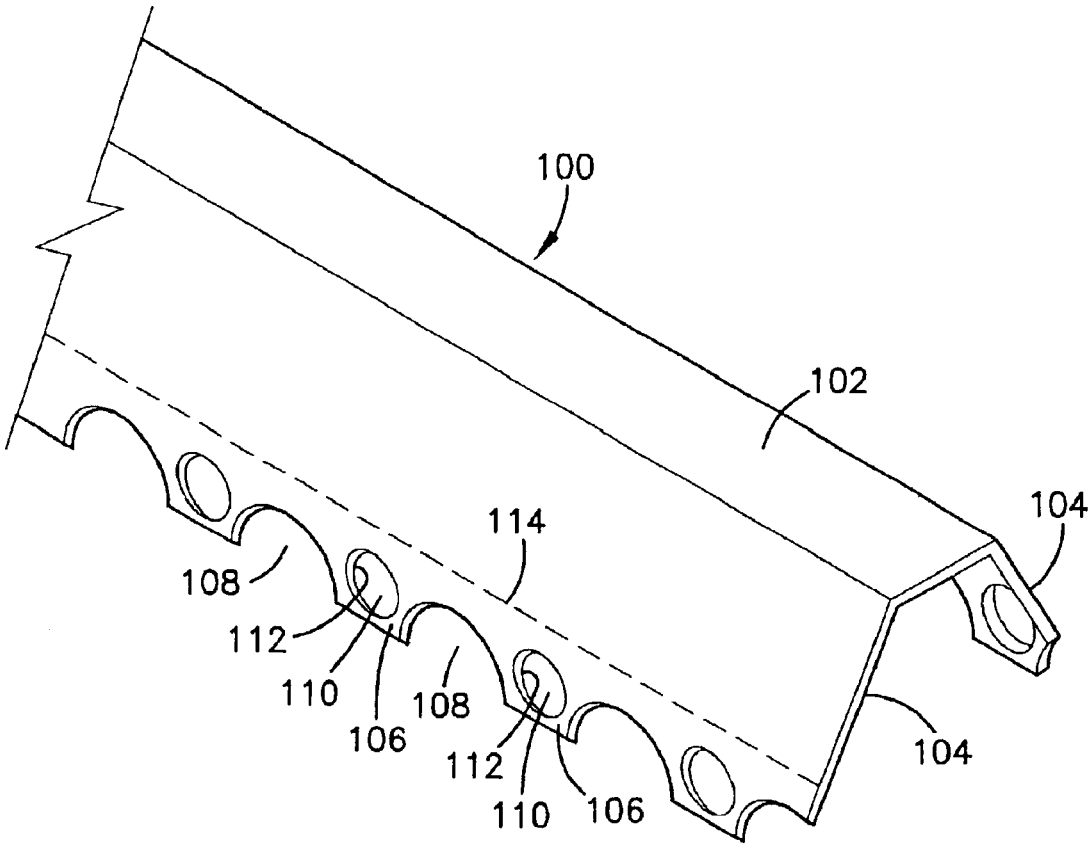
FIG. 11 is an isometric view of an alternative channel design suitable for use in the prefabricated wall panel of the present invention.

Referring to FIG. 11, an alternative channel 100 is illustrated as generally including a cross member 102 and a pair of side members 104 extending and diverging from opposite edges of cross member 102. Each side member 104 includes a plurality of projections 106 defined between a plurality of notches 108. Each projection includes an opening 110 extending therethrough. Each opening 110 presents a holding surface 112. Channel 100 is configured to be partially embedded in a concrete slab up to embedding line 114 so that projections 106 and openings 110 are embedded in the concrete slab. Notches 108 allow steel reinforcement members to be extended therethrough. When channel 100 is embedded in concrete, openings 110 are filled with concrete and holding surfaces 112 resist pull out of channel 100 from the concrete slab.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A lightweight precast wall panel comprising:

a concrete slab; and a plurality of elongated spaced-apart channels coupled to the slab, each of said channels including a substantially flat cross member and a pair of spaced-apart side members extending from the cross member, said side members being partially embedded in the slab, said cross member being spaced from the slab, said side member including a proximal end proximate the cross member and a distal end at least partly embedded in the slab, said distal end of the side member presenting a plurality of projections defined between a plurality of notches.

2. The wall according to claim 1, each of said channels being formed of a single piece of sheet metal.

3. The wall according to claim 1, said channels extending generally parallel to one another, said channels extending substantially the full width of the slab.

4. The wall panel according to claim 3, each of said channels being formed of a single piece of bent 14–26 gauge sheet metal.

5. The wall panel according to claim 1, each of said channels having a substantially hat-shaped orthogonal cross section.

6. The wall panel according to claim 1, said wall panel having a weight in the range of from about 4 to about 30 pounds per square foot, said concrete slab having a thickness in the range of from about 1 to about 4 inches.

7. The wall panel according to claim 1, said cross member being spaced at least about 0.25 inches from the slab.

8. The wall panel according to claim 7, said slab presenting a substantially flat inside surface from which the channels project, said cross member being defined along a plane that is at least substantially parallel to the inside surface of the slab.

9. The wall panel according to claim 8, said cross member being spaced from the inside surface of the slab a distance in the range of from about 0.5 to about 3 inches.

10. The wall panel according to claim 9, said cross member being formed of metal, said cross member having a thickness in the range of from about 0.02 to about 0.1 inches.

11. The wall panel according to claim 1, each of said cross members of said plurality of channels presenting a respective substantially flat outer channel surface, said outer channel surfaces of said plurality of channels being substantially coplanar.

12. The wall panel according to claim 1, said side members diverging from one another as the side members extend away from the cross member, said side members extending from the cross member at a divergence angle in the range of from about 15 to about 45 degrees.

13. The wall panel according to claim 1, each of said projections extending at least 0.5 inches into the slab, each of said notches extending in the range of from about 0.25 to about 2 inches into the side member with which that notch is associated.

14. The wall panel according to claim 1, each of said projections presenting a holding surface embedded in the slab, said holding surface being adapted to substantially prevent the channel with which the holding surface is associated from pulling out of the slab, said holding surface extending generally transverse to the direction in which the side member with which that holding surface is associated extends from the cross member, said holding surface facing more towards the cross member with which that holding surface is associated than away from the cross member with which that holding surface is associated.

15. The wall panel according to claim 1, each of said projections including a substantially flat leg portion and a substantially flat foot portion, each of said foot portions being entirely embedded in the slab, each of said foot portions extending along a plane that is transverse to the plane along which the leg portion associated with that foot portion extends.

16. The wall panel according to claim 1, said cross member being coupled to and extending generally between the proximal ends of the side members.

* * * * *